US010959537B1

(12) United States Patent
Fernandez

(10) Patent No.: US 10,959,537 B1
(45) Date of Patent: Mar. 30, 2021

(54) ACTIVITY SAUCER FOR INFANTS WITH CLUBFOOT

(71) Applicant: Austin Fernandez, Anchorage, AK (US)

(72) Inventor: Austin Fernandez, Anchorage, AK (US)

( * ) Notice: Subject to any disclaimer, the term of this patent is extended or adjusted under 35 U.S.C. 154(b) by 0 days.

(21) Appl. No.: 16/672,956

(22) Filed: Nov. 4, 2019

(51) Int. Cl.
*A47D 1/00* (2006.01)
*A47D 15/00* (2006.01)

(52) U.S. Cl.
CPC ..... *A47D 1/0081* (2017.05); *A47D 15/00* (2013.01)

(58) Field of Classification Search
CPC ..... A47D 1/00; A47D 1/0081; A47D 15/00; A47C 7/52
See application file for complete search history.

(56) References Cited

U.S. PATENT DOCUMENTS 4,441,221 A * 4/1984 Enste ..... A61G 5/1091 5/657
5,688,211 A * 11/1997 Myers ..... A47D 13/107 297/5
5,860,696 A * 1/1999 Opsvik ..... A47D 1/00 297/219.1
6,000,750 A * 12/1999 Rossman ..... A47D 1/004 108/11
6,637,814 B1 * 10/2003 Bellows ..... A63H 33/00 297/137
7,510,238 B2 * 3/2009 McClintock ..... A47D 3/00 297/137
7,735,911 B2 * 6/2010 Chen ..... A47D 1/002 297/16.1
7,740,560 B2 * 6/2010 Tadin ..... A47D 13/107 482/27
8,302,978 B2 * 11/2012 You ..... A47D 13/043 280/87.051
8,960,788 B2 * 2/2015 Chuah ..... A47D 1/0081 297/153
9,119,481 B2 * 9/2015 Varney ..... A47D 1/0081
10,285,509 B2 * 5/2019 Aguillard ..... A47D 1/0081
10,631,662 B2 * 4/2020 Stachowski ..... A47D 1/106
2012/0061999 A1 * 3/2012 Soriano ..... A47D 1/0081 297/174 R

* cited by examiner

*Primary Examiner* — Philip F Gabler
(74) *Attorney, Agent, or Firm* — Michael J. Tavella

(57) ABSTRACT

A baby activity saucer with a movable upper tray that allows for inserting a baby with clubfoot cast, braces and bars that does not require the bar to be removed. The sliding upper tray of the clubfoot activity saucer has a latch that when triggered, unlatches the upper tray from the bottom tray allowing it to slide and to be adjusted for a smaller or larger opening. The seat has a back the curves into a horn that extends forward to allow an infant to straddle the horn. A foot plate is used to hold the bar in a fixed position. The device has a set of pegs that allow the foot plate to be moved up or down to a desired height, to allow the baby to exercise his/her legs safely. The device can be made with or without wheels, depending on whether motion is desired or not.

18 Claims, 9 Drawing Sheets

ACTIVITY SAUCER FOR INFANTS WITH CLUBFOOT

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to infant activity saucers and particularly to infant activity saucer for infants with clubfoot.

2. Description of the Prior Art

When clubfoot infants undergo the Ponseti method for repairing their clubfeet, infants wear a cast for about two months. After casting they undergo surgery. After surgery, they must wear braces and a bar to hold the feet on an outside angle, this bar is connected to both feet to hold the braces at the proper angle. The success rate to correct clubfeet depend on the infants wearing their braces for 23 hours a day for 3 months. After that, a doctor recommends how much more time is needed. Eventually, the time is slowly tapered off.

Regular baby exercise saucers or walkers have seats that have two holes for the legs of the baby, this works great for inserting a baby by putting one leg through each of the openings. However, regular baby exercisers make it difficult for infants with clubfeet to enjoy the benefits and comfort of using an exercise saucer because of the braces and bars that hold their feet apart.

Presently there is no solution for using a baby exercise saucer or an activity saucer that does not require the removal of the bar or braces before inserting the baby in such saucer; and then having to reinstall the bar and/or braces. It is difficult for both the parent and the baby to undergo removal of the bar every time the use of the saucer is desired. Continuous removal of the braces and bar also greatly increases the chance of clubfoot relapse.

BRIEF DESCRIPTION OF THE INVENTION

The present invention provides a solution to this problem by providing a baby activity saucer with a movable upper tray that allows for inserting a baby with clubfoot cast, braces and bars that does not require the bar to be removed. The present invention also introduces a method to adjust the opening of the baby area to accommodate petite or large babies.

The sliding upper tray of the clubfoot activity saucer has a latch that when triggered, unlatches the upper tray from the bottom tray allowing it to slide and to be adjusted for a smaller or larger opening. The seat of the clubfoot activity saucer is a standard type seat that is strong to support a baby. The seat is also sufficiently padded to be comfortable for the baby to sit on. It also has a horn formed on the front. The horn is much like a bicycle seat in that it allows an infant to straddle the seat so that, when able, the infant can stand while being restrained by the tray. The horn also makes putting an infant in the seat easier.

Clubfoot braces are made of a plastic material so they slide easy on any hard surface, a foot plate, that can be positioned at an adjustable height, is designed to provide traction that allows a baby to push himself up exercising his legs. The foot plate also has blocks that hold the bar in a fixed position for additional safety.

Preferably, the clubfoot activity saucer has a latch release underneath the front end of the upper tray allowing for a one hand operation so that when the latch release is activated the upper tray is able to slide to a desired opening, allowing a baby wearing a cast or bar and braces to be placed on the seat. The baby is then held in place with one hand and the other hand is then used to close the upper tray to the desired width, thereby fully enclosing the baby safely on the seat. Also, preferably, the device has a set of pegs that allow the foot plate to be moved up or down to a desired height, to allow the baby to exercise his/her legs safely.

The device can be made with or without wheels, depending on whether motion is desired or not.

DETAILED DESCRIPTION OF THE INVENTION

Figure 1:
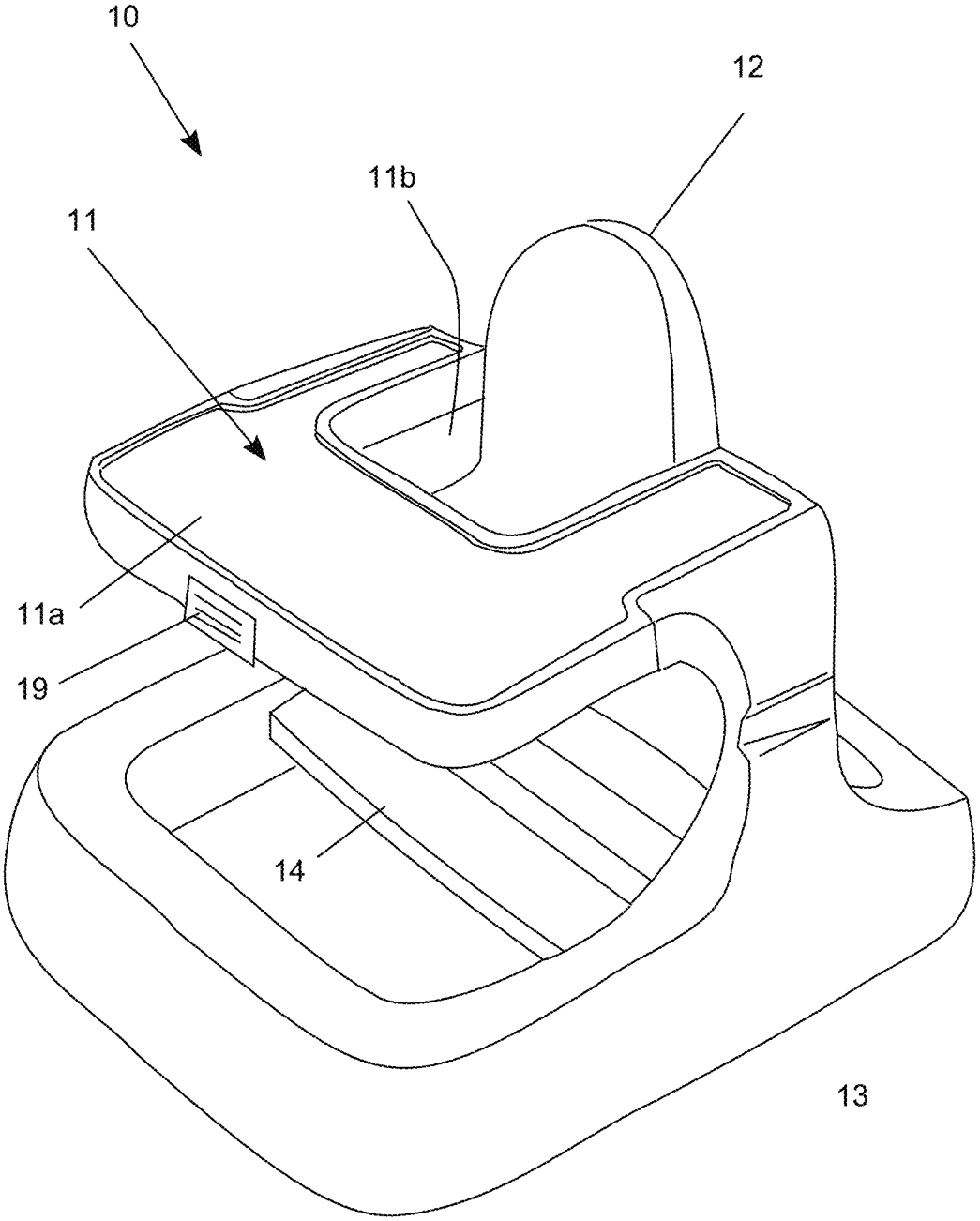
FIG. 1 is a top perspective view of the invention with the upper tray in the closed position.

Referring now to the drawings, FIG. 1 is a top perspective view of the invention with the upper tray in the closed position. In this view, the device 10, has a top tray system 11, a seat 12, a formed base 13, and an adjustable foot plate 14. The top tray system 11 is discussed below. The seat 12 is attached to the housing. The seat 12 is designed to accommodate the infant without having to remove the clubfoot brace. The seat 12 has a horn 12*a* formed on the front (see FIG. 9). The horn 12*a* is much like a bicycle seat in that it allows an infant to straddle the seat so that, when able, the infant can stand while being restrained by the tray. The horn 12*a* also makes putting an infant in the seat easier.

Note that a latch release 19 is shown at the front of the tray system 11. The latch 19 allows a user to operate the tray with one hand for additional convenience.

Figure 2:
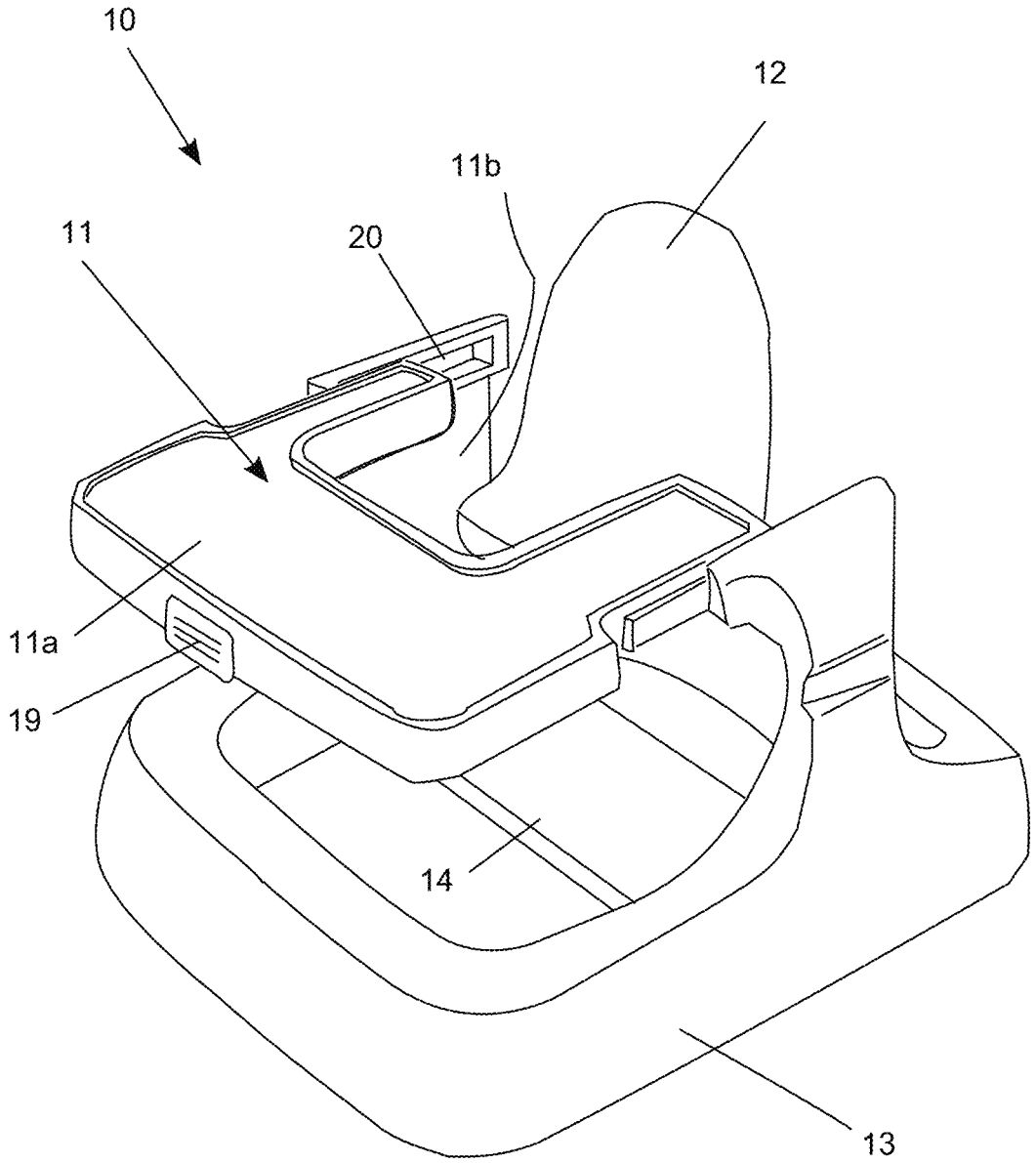
FIG. 2 is a top perspective view of the invention with the upper tray in the open position.

FIG. 2 is a top perspective view of the invention with the upper tray in the open position. Here, the top tray system 11 is shown. When the tray 11*a* is closed (as it is in FIG. 1), it has an opening 11*b* that is large enough to hold the infant securely but comfortably within the device without enabling the infant to egress the device. In FIG. 2, the tray 11*a* is opened. As shown, the opening 11*b* is wider, allowing the infant to be easily placed on the seat 12 while wearing the bar. Note the seat 12 is secured to the formed base 13. Note that the latch release 19 operates to open a pair of latches (not shown) that release the tray and allow it to move. The tray 11 rides in groove 20 as shown in FIGS. 2 and 4.

Figure 3:
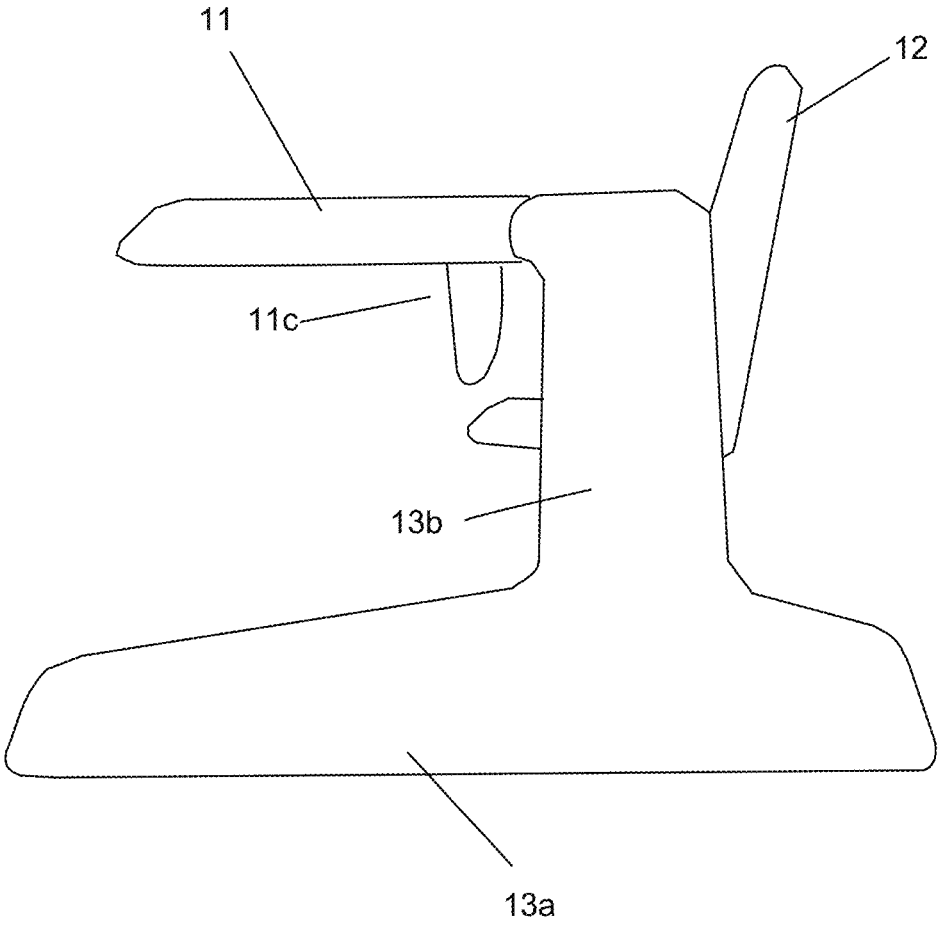
FIG. 3 is a side view of the invention with the upper tray in the closed position.

FIG. 3 is a side view of the invention with the upper tray in the closed position. In this view, the formed base 13 is shown. Note that the formed base 13 has a generally square lower portion 13*a* and two vertical sides 13*b* and 13*c* that extend upwards to form the connection to the tray 11. Note also the seat 12 and its position. The tray 11 also has a lower horn 11*c*. This horn is used to help hold the infant in the seat 12 when the tray is closed. With the tray 11*a* closed, the horn 11*c* prevents the infant from sliding forward off the seat 12. Note that in FIGS. 3-7 the foot plate 14 is not shown.

Figure 4:
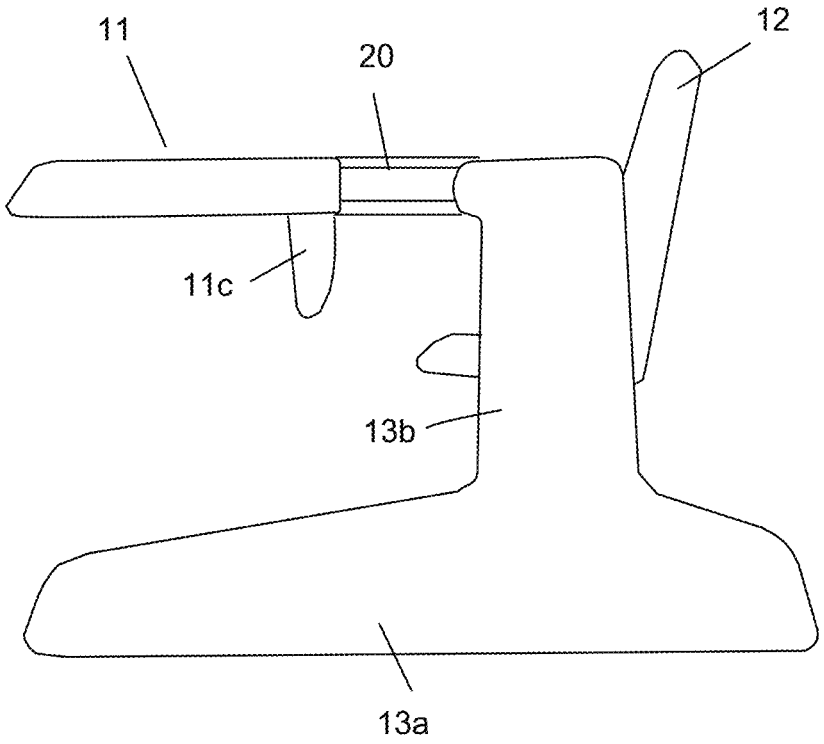
FIG. 4 is a side view of the invention with the upper tray in the open position.

FIG. 4 is a side view of the invention with the upper tray in the open position. As before, the formed base 13 is shown. Note the seat 12 and its position. The lower horn 11*c* of the tray 11 is shown pulled forward from the seat. In this position and infant can be placed in the seat 12 without difficulty. As noted above, this horn is used to help hold the infant in the seat 12 when the tray is closed. Note the groove 20 in which the tray 11 rides.

Figure 5:
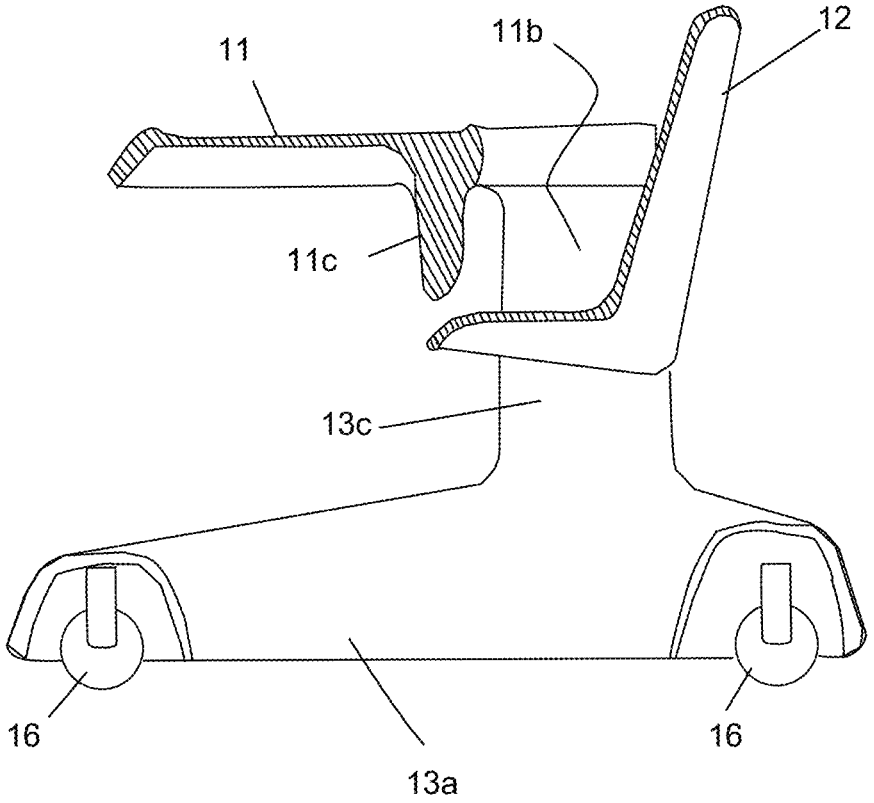
FIG. 5 is a side cut-away view of the invention with the upper tray in the closed position also showing optional wheels.
Figure 6:
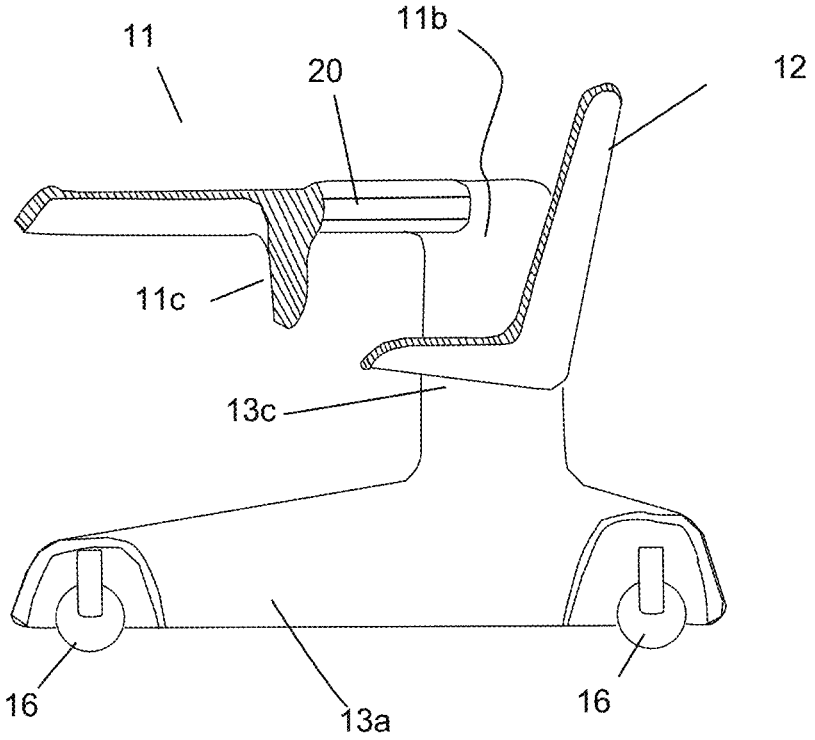
FIG. 6 is a side cut-away view of the invention with the upper tray in the open position also showing optional wheels.
Figure 9:
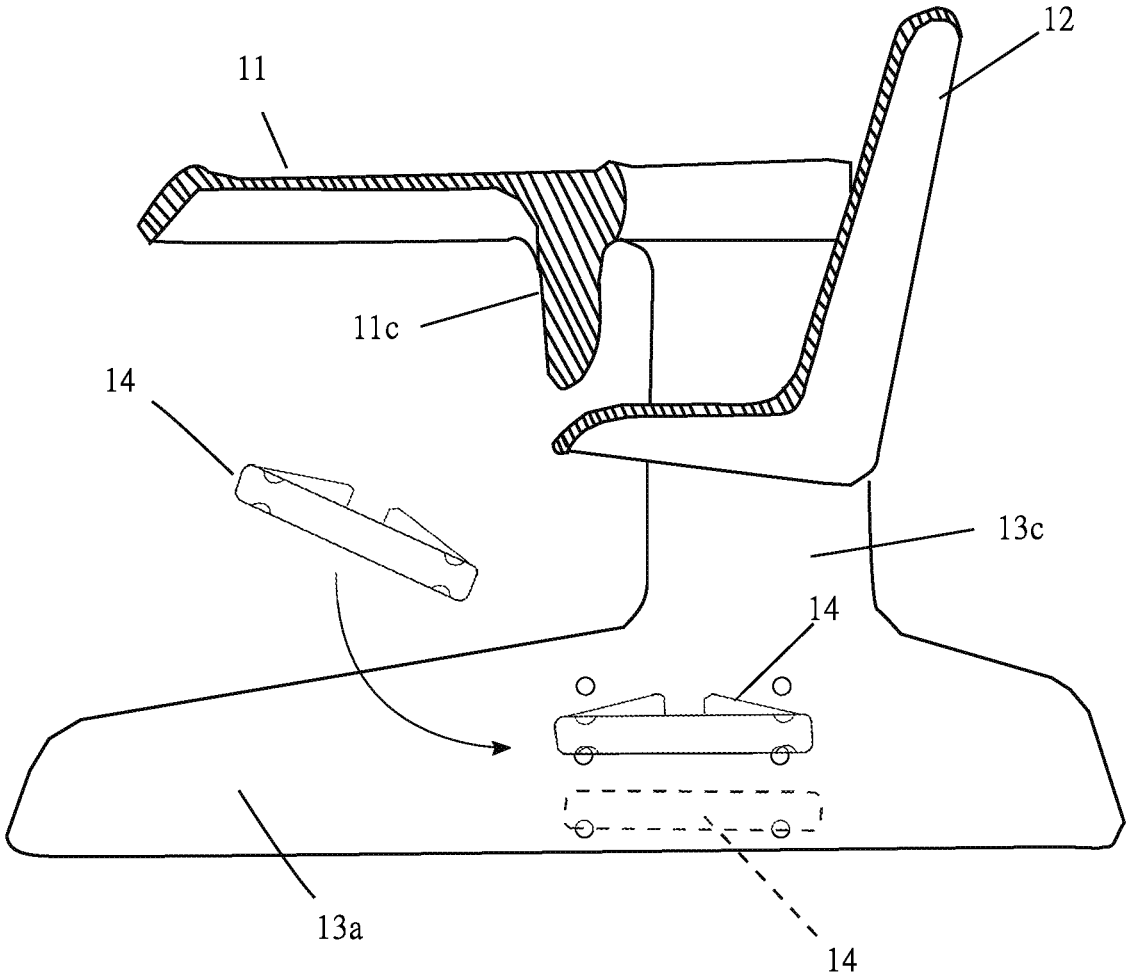
FIG. 9 is a detail view of the foot plate and possible installation locations of the foot plate in the device.
Figure 10:
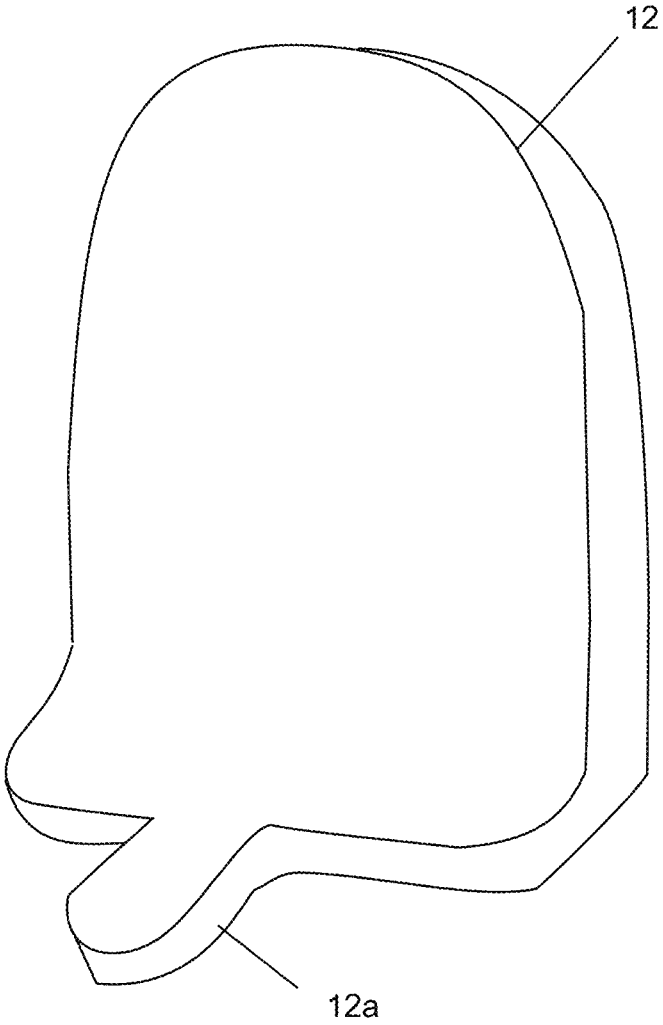
FIG. 10 is a front perspective view of the seat, showing the horn.

FIG. 5 is a side cut-away view of the invention with the upper tray in the closed position also showing optional wheels. FIG. 6 is a side cut-away view of the invention with the upper tray 11 in the open position also showing optional wheels 16. Note that the figure shows two wheels 16 that are attached on the left side of the formed base. Two additional wheels 16 are attached to the right side of the lower portion 13*a* of the formed base 13 to form a set of wheels. The wheels are used in an optional model that allows for mobility of the device. In the preferred embodiment, the wheels 16 are not used to provide additional safety for the child. Note that this figure also shows a view of the seat horn 12*a* this feature is also shown in FIGS. 6, 9 and 10.

FIGS. 5 and 6 show that seat 12, which is positioned as shown. Note that these figures do not show the adjustable foot plate 14. Note too that in FIG. 6, the lower horn 11*c* of the tray is advanced forward and the space 11*b* is larger to accommodate the infant being placed in the seat. Note too, that FIGS. 5 and 6 also show left vertical side 13*c*.

Figure 7:
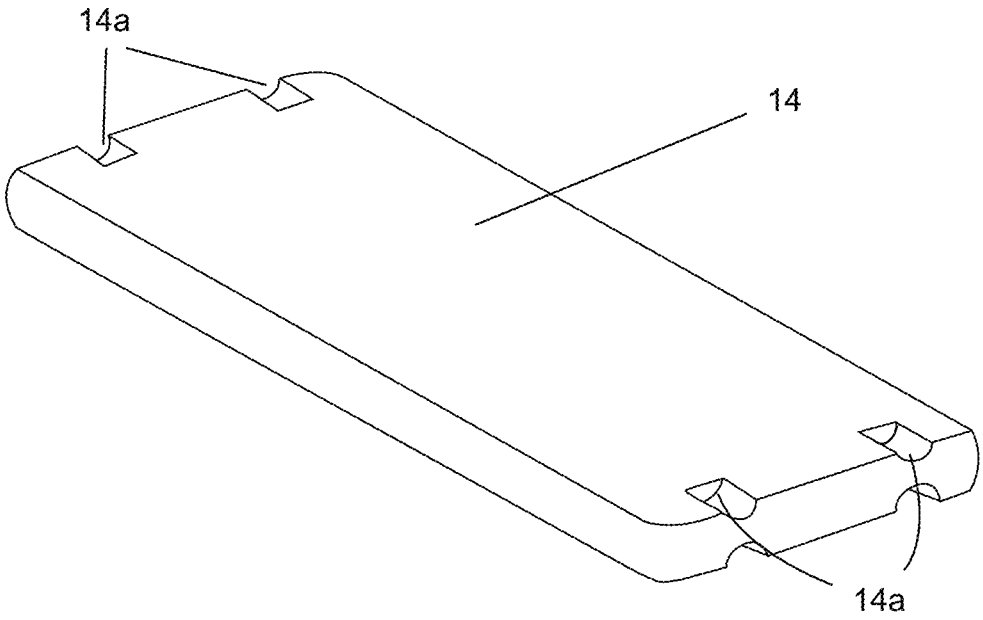
FIG. 7 is a bottom perspective view of the removable foot plate.

FIG. 7 is a bottom perspective view of the removable foot plate 14. The bottom of the foot plate is flat, as shown. Eight notches 14*a* are shown. There are four notches 14*a* cut in the bottom of the foot plate 14 and four notches 14*a* cut into the top. These notches are used to place the foot plate onto pegs on the inside of the formed base 13. See FIG. 9.

Figure 8:
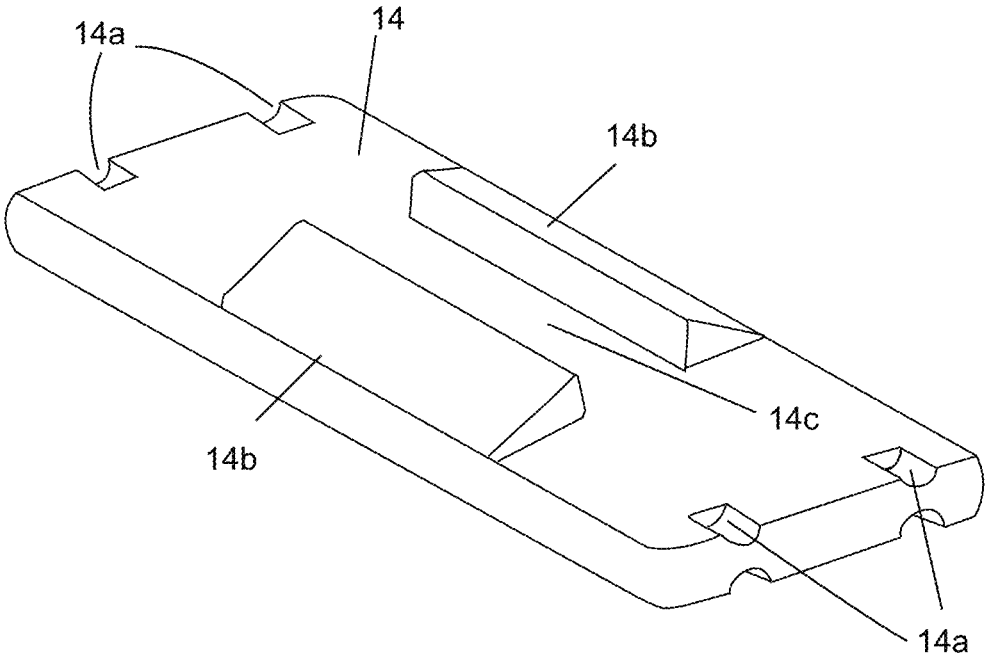
FIG. 8 is a top perspective view of the removable foot plate, showing the groove to hold the bar or braces.

FIG. 8 is a top perspective view of the removable foot plate, showing the groove 14*c* to hold the bar or braces. Note the four notches 14*a* on the top of the foot plate 14. On the top of the foot plate are two wedges 14*b*. These wedges are placed to form a space 14*c* into which, the bar is placed. This ensures that the bar cannot be readily moved then the child is in the device. When the bar is removed, the child can use the device with the foot plate flipped over so the flat bottom is used.

FIG. 9 is a detail view of the foot plate and possible installation locations of the foot plate 14 in the device. Note that, in the preferred embodiment, there are nine pegs 17 installed in the formed base 13. These pegs are used to hold the foot plate 14 as shown. In this way, the foot plate can be placed in three different positions as needed. Moreover, because notches 14*a* are present on both sides of the foot plate, the tray can be installed right side up or upside down, as desired. Note the foot plate 14 shown in dashed lines is shown flipped.

Note too, that this figure shows the foot plate 14 angled for insertion into the formed base. As shown in FIG. 1, the formed base 13 has an opening in the bottom to allow for the insertion of the foot plate 14. By angling the foot plate 14 it is possible to insert it at any of the three levels within the formed base 13.

FIG. 10 is a front perspective view of the seat 12, showing the horn 12*a*. In this view, the seat 12 is shown with a back 12*b* that curves at the base as shown. from this, the seat horn 12*a* extends a shown. As noted above, the seat horn 12*a* allows an infant to straddle the seat, which allows the infant to stand, when able.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An activity saucer for infants with clubfoot comprising:

a) a formed base;

b) a top tray system, adjustably attached to said formed base;

c) a seat, attached to said formed base; and d) a foot plate having a top and a bottom and a latitudinal axis, said foot plate further having a pair of blocks positioned on the top of said foot plate such that each of said pair of blocks is oppositely disposed about said latitudinal axis and spaced apart to form a groove therebetween, said foot plate being adjustably installed in said formed base.

2. The activity saucer for infants with clubfoot of claim 1 wherein the formed base has a generally square lower portion, and two vertical sides extending upwardly therefrom.

3. The activity saucer for infants with clubfoot of claim 2 further comprising a set of wheels attached to the generally square base.

4. The activity saucer for infants with clubfoot of claim 2 further comprising at least two pegs attached to each of said two vertical sides of said formed base to hold said foot plate.

5. The activity saucer for infants with clubfoot of claim 2 further comprising three pairs of pegs attached to each of said two vertical sides of said formed base to hold said foot plate at different positions within said formed base.

6. The activity saucer for infants with clubfoot of claim 2 wherein the seat is positioned between the two vertical sides of said formed base.

7. The activity saucer for infants with clubfoot of claim 1 wherein the top tray system has an open position and a closed position.

8. The activity saucer for infants with clubfoot of claim 1 wherein the top tray system includes a lower horn, attached to said top tray system and extending downwardly therefrom.

9. The activity saucer for infants with clubfoot of claim 1 wherein the footplate further comprises: four notches cut in the bottom of the foot plate and four notches cut into the top of said foot plate.

10. The activity saucer for infants with clubfoot of claim 9 further comprising three pairs of pegs attached to each of said two vertical sides of said formed base to hold said foot plate at different positions within said formed base.

11. The activity saucer for infants with clubfoot of claim 10 wherein the notches on said foot plate are placed over one of said pairs of pegs on each of said two vertical sides of said formed base.

12. The activity saucer for infants with clubfoot of claim 9 wherein the bottom of said foot plate has a flat surface.

13. The activity saucer for infants with clubfoot of claim 1 wherein said pair of blocks comprise: a pair of wedges.

14. The activity saucer for infants with clubfoot of claim 13 wherein each of said pair of wedges has a vertical back and a sloped front, and further wherein each of said pair of wedges is positioned such that the vertical back of each of said pair of wedges are oppositely disposed to form said groove therebetween.

15. The activity saucer for infants with clubfoot of claim 1 further comprising a set of wheels attached to the formed base.

16. The activity saucer for infants with clubfoot of claim 1 wherein the seat further comprises:

a) a back portion extending vertically; and b) a horn, extending perpendicularly outwardly forward from said back.

17. The activity saucer for infants with clubfoot of claim 16 wherein the horn is shaped to allow and infant to straddle said horn.

18. The activity saucer for infants with clubfoot of claim 1 wherein the pair of blocks runs parallel to said latitudinal axis on said foot plate.

* * * * *